US010957983B2

(12) United States Patent
Zhou et al.

(10) Patent No.: US 10,957,983 B2
(45) Date of Patent: Mar. 23, 2021

(54) DIPOLE

(71) Applicant: Nokia Shanghai Bell Co., Ltd., Shanghai (CN)

(72) Inventors: Jie Zhou, Shanghai (CN); Yuzhi Ding, Shanghai (CN); Bo Zhao, Shanghai (CN)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 1 day.

(21) Appl. No.: 16/343,659

(22) PCT Filed: Oct. 20, 2017

(86) PCT No.: PCT/CN2017/107062
§ 371 (c)(1),
(2) Date: Apr. 19, 2019

(87) PCT Pub. No.: WO2018/072744
PCT Pub. Date: Apr. 26, 2018

(65) Prior Publication Data

US 2019/0280388 A1 Sep. 12, 2019

(30) Foreign Application Priority Data

Oct. 21, 2016 (CN) ..... 201610920764.1

(51) Int. Cl.

| | |
|---|---|
| ***H01Q 9/28*** | (2006.01) |
| ***H01Q 1/36*** | (2006.01) |
| ***H01Q 19/10*** | (2006.01) |
| ***H01Q 1/50*** | (2006.01) |

(52) U.S. Cl.
CPC ..... *H01Q 9/285* (2013.01); *H01Q 1/36* (2013.01); *H01Q 1/50* (2013.01); *H01Q 19/10* (2013.01)

(58) Field of Classification Search
None
See application file for complete search history.

(56) References Cited

U.S. PATENT DOCUMENTS

| | | | | |
|---|---|---|---|---|
| 6,608,600 | B2 * | 8/2003 | Eriksson | H01Q 1/246 343/797 |
| 7,579,999 | B2 * | 8/2009 | Boβ | H01Q 9/06 343/795 |
| 8,878,742 | B1 | 11/2014 | Jenn | |

(Continued)

FOREIGN PATENT DOCUMENTS

| | | |
|---|---|---|
| CN | 101542838 A | 9/2009 |
| CN | 101707287 A | 5/2010 |
| CN | 201766165 U | 3/2011 |

(Continued)

OTHER PUBLICATIONS

International Search Report for PCT/CN2017/107062 dated Jan. 19, 2018.

*Primary Examiner* — Anh Q Tran
(74) *Attorney, Agent, or Firm* — Fay Sharpe LLP

(57) ABSTRACT

The present disclosure provides a dipole, wherein the dipole comprises a dipole body and a feeding line used for connecting to the dipole body, wherein the dipole body comprises an asymmetric wing feature structure. According to the present disclosure, the dipole can obviously improve ±60° cross-polarization and VSWR performance, and can greatly reduce weight and reduce assembly costs.

7 Claims, 6 Drawing Sheets

(56) References Cited

U.S. PATENT DOCUMENTS

| | | | | |
|---|---|---|---|---|
| 2005/0134517 | A1* | 6/2005 | Gottl | H01Q 1/246 343/797 |
| 2012/0200470 | A1 | 8/2012 | Cooper et al. | |

FOREIGN PATENT DOCUMENTS

| | | | | |
|---|---|---|---|---|
| CN | 103337716 | A | 10/2013 | |
| CN | 103633422 | A | 3/2014 | |
| CN | 103700927 | A | 4/2014 | |
| CN | 203660065 | U | 6/2014 | |
| CN | 105680169 | A | 6/2016 | |
| CN | 206076493 | U | 4/2017 | |
| EP | 3 035 438 | A1 | 12/2014 | |
| WO | WO-2015062545 | A1 * | 5/2015 | H01W 21/062 |

* cited by examiner

DIPOLE

TECHNICAL FIELD

The present disclosure relates to the field of antenna technology, and in particular to a dipole.

BACKGROUND

In the field of antenna technology, dipole, as a key part of transmitting and receiving signals, plays a key role in performance and cost of antenna. However, the dipole currently used in the prior art has the following disadvantages:

1) High cost. The cost of existing dipole assembly mainly come from: the cost of a single dipole body and feeding line, as well as the cost of soldering between the dipole and the feeding line. Existing dipole(s) uses copper bar as feeding line, and after die casting on the dipole body, it is necessary to machine step hole or the like to achieve impedance matching. This makes the manufacturing cost of the dipole very high, and the connection between the dipole body and the feeding line is realized by soldering at top side, which easily leads to the unstable soldering quality.

2) Low performance. For the existing dipole, good soldering quality is the premise of stable performance, however, the soldering process is hard to control very well. The machined step is hard to adjust impedance matching as well as need and the machined step is not very stable for different batch.

3) Heavy weight. The weight of a single dipole assembly is about 45 g. Assuming that 1.3 m side-by-side SBS antenna with 22 dipoles is adopted, the weight of dipoles accounts for 6.4% of the total weight of the antenna. The heavier the antenna is, the more stringent the requirements on its assembly will be. This makes the weight of the dipole become a disadvantage factor for reducing the cost of the antenna.

In view of the above disadvantages, the following solutions are proposed in the prior art, but the effect is not satisfactory:

1) Cost side: for surface treatment, tin-plating instead of silver-plating in order to reduce the plating cost; for the direct connection between the dipole body and the feeding line, the reflow soldering is adopted instead of the resistance soldering. The whole dipole assembly can be outsourced and the cost assessment of the dipole assembly can be negotiated with the supplier to reduce the cost of the single dipole body and the dipole assembly.

2) Performance side: use automatically soldering equipment instead of artificial soldering to provide stability of soldering quality.

BRIEF SUMMARY

The purpose of the present disclosure is to provide a new type of dipole with high performance and low cost.

According to one aspect of the present disclosure, a dipole is provided, wherein the dipole comprises a dipole body and a feeding line used for connecting to the dipole body, wherein the dipole body comprises an asymmetric wing feature structure.

According to one aspect of the present disclosure, the asymmetric wing feature structure is of slim shape.

According to one aspect of the present disclosure, the shape of the feeding line can be adjusted to achieve impedance matching.

According to one aspect of the present disclosure, the dipole also comprises plastic part(s), and the feeding line is connected with the dipole body in a capacity coupled manner through the plastic part(s).

Compared with the prior art, the present disclosure has the following advantages: the adoption of asymmetric wing feature structure can obviously improve ±60° Cross-Polarization and Voltage Standing Wave Ratio (VSWR) performance, and the wing feature structure can be designed as slim shape, it can greatly reduce the weight of the dipole and reduce the plating area, thereby reducing the weight of the antenna using the dipole and reducing the cost, and facilitating the antenna assembly. Impedance matching can be achieved by adjusting the shape of the feeding line, so there is no need to machine step hole or the like after die casting on the dipole body. The feeding line can be connected with the dipole in a capacity coupled manner through plastic part(s), thus not only reducing the soldering cost, but also improving the PIM stability.

BRIEF DESCRIPTION OF THE ACCOMPANYING DRAWINGS

Other features, objectives, and advantages of the present disclosure will become more apparent through reading the following detailed depiction of the non-limitative embodiments with reference to the accompanying drawings.

Same or similar reference numerals in the drawings represent same or similar components.

DETAILED DESCRIPTION

Figure 1:
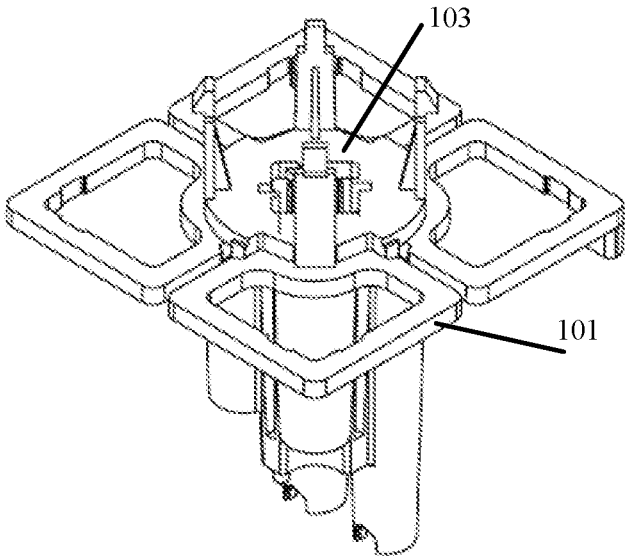
FIG. 1 shows a structural diagram of an example dipole of the present disclosure.

Hereinafter, further detailed description will be made to the present disclosure with reference to the accompanying drawings.

The present disclosure provides a dipole, wherein the dipole comprises a dipole body and a feeding line used for connecting to the dipole body, wherein the dipole body comprises an asymmetric wing feature structure, wherein the dipole can be applied to all high-frequency and low-frequency base station antennas, and preferably, the dipole is applied to high-frequency ultra wide band.

Wherein, the asymmetric wing feature structure is located on the wing(s) of the dipole body and is placed asymmetrically. It should be noted that the "asymmetric" mentioned here refers to the non-central symmetry, that is, the wing feature structure is asymmetrically placed with respect to the center of the dipole body.

It should be note that, because the dipole uses the asymmetric wing feature structure, the antenna based on the dipole can obviously improve ±60° Cross-Polarization and VSWR (Voltage Standing Wave Ratio) performance, which greatly improves the quality of the antenna.

As a preferred solution, the asymmetric wing feature structure is of slim shape, such as slim cylindrical shape. This preferred solution can greatly reduce the weight of the dipole and reduce the plating area, thereby reducing the weight of the antenna using the dipole, reducing the cost, and facilitating the antenna assembly.

Wherein the feeding line can adopt any feasible structure, such as metal sheet structure or die casting structure, etc.

As a preferred solution, the shape of the feeding line can be adjusted, that is, the feeding line adopts a structure with adjustable shape, such as a sheet metal structure or a die casting structure with adjustable shape. This optimal solution can achieve impedance matching without machining step hole or the like structures after die casting for the dipole body, that is, the dipole body does not do impedance matching, but achieves impedance matching by adjusting the shape of the feeding line.

As a preferred solution, the dipole also includes plastic part(s), and the feeding line is connected with the dipole body in a capacity coupled manner through the plastic part(s), wherein the plastic part(s) is used to provide dielectric support for the capacity coupled manner. This preferred solution can not only reduce the soldering cost, but also improve the stability of PIM (Passive Inter Modulation).

More preferably, the dipole may include only one plastic part. This can save a plastic part compared with the prior art, thus further reduce the assembly cost and simplify the assembly process.

Wherein, the plastic part comprises a clip structure which is used to fix other structures on the dipole. Preferably, one plastic part includes three or more clip structures to ensure the stability of connections with other structures.

As a preferred solution, the dipole is connected to the reflector plate in a screw connection manner. For example, the dipole is fixed on the reflector plate through an M4 screw. This preferred solution can ensure the stability of the connection with the reflector plate, thus providing more stable dynamic PIM performance.

Figure 2:
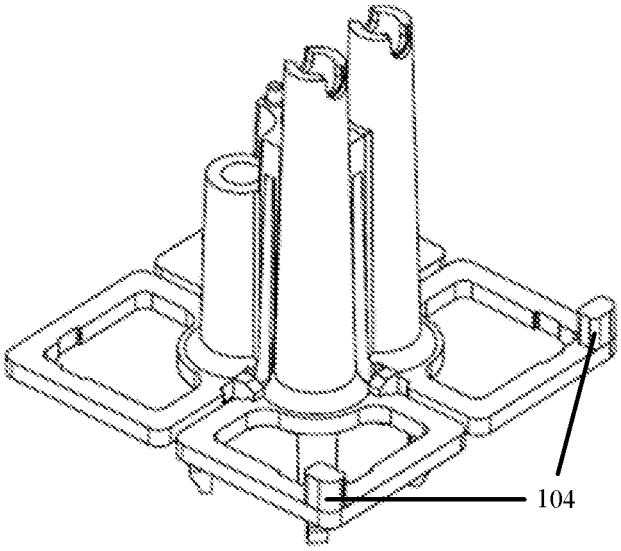
FIG. 2 shows the structural diagram of another angle of the dipole shown in FIG. 1.
Figure 3:
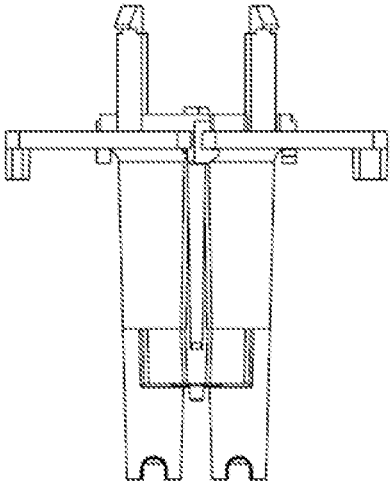
FIG. 3 shows the side view of the dipole shown in FIG. 1.
Figure 4:
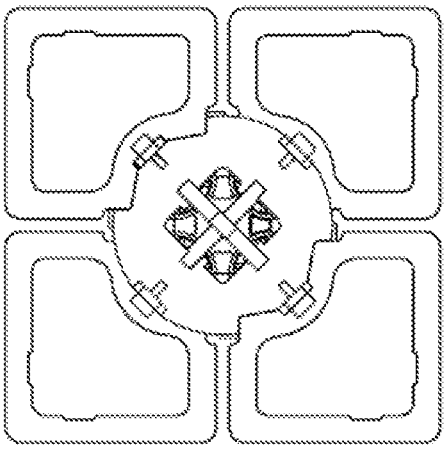
FIG. 4 shows the top view of the dipole shown in FIG. 1.
Figure 5:
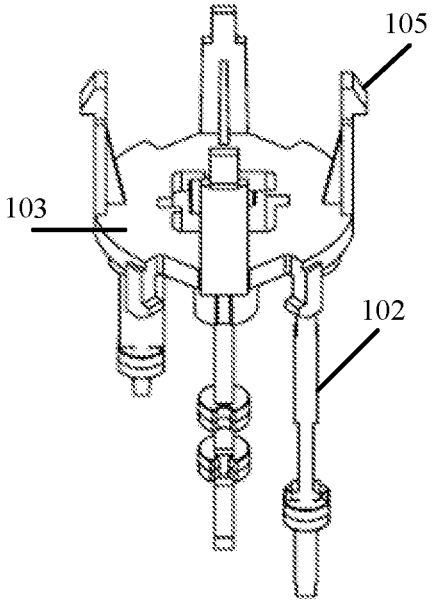
FIG. 5 shows a schematic diagram of the structure formed by connecting the plastic part and the feeding line in the dipole shown in FIG. 1.
Figure 6:
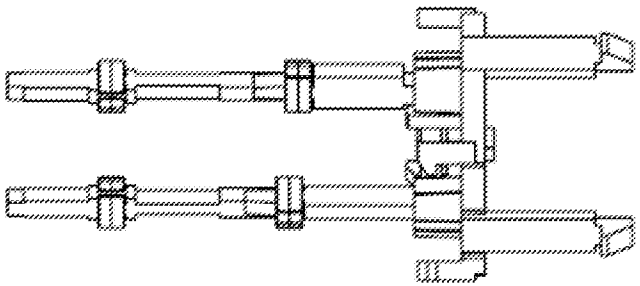
FIG. 6 shows the side view of the structure shown in FIG. 5.
Figure 7:
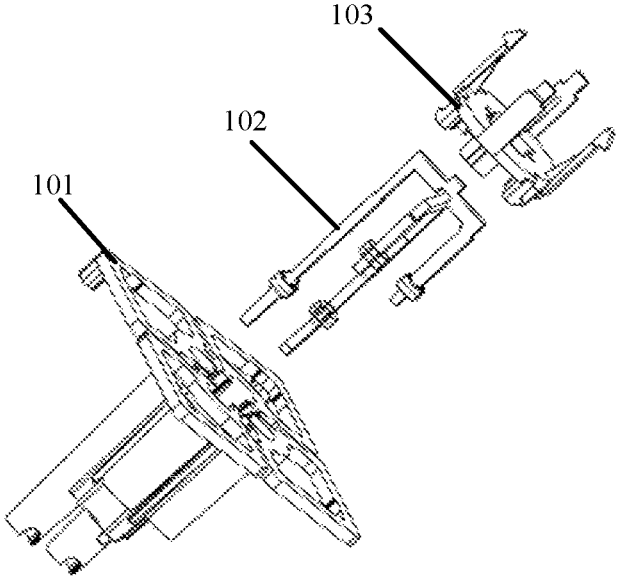
FIG. 7 shows the assembly diagram of the dipole shown in FIG. 1.

FIG. 1 shows the structural diagram of a dipole according to a preferred embodiment of the present disclosure; FIG. 2 shows the structural diagram of another angle of the dipole shown in FIG. 1, that is, the structural diagram of the dipole shown in FIG. 1 after upside down; FIG. 3 shows the side view of the dipole shown in FIG. 1; FIG. 4 shows the top view of the dipole shown in FIG. 1; FIG. 5 shows a schematic diagram of the structure formed by connecting the plastic part and the feeding line in the dipole shown in FIG. 1; FIG. 6 shows the side view of the structure shown in FIG. 5; FIG. 7 shows the assembly diagram of the dipole shown in FIG. 1. As can be seen from FIG. 1 to FIG. 7, the dipole comprises dipole body 101, feeding line 102 and plastic part 103; wherein, the dipole body 101 includes asymmetric wing feature structures 104, as shown in FIG. 2, two wing feature structures 104 are respectively placed on two adjacent wings of the dipole body. Wherein the feeding line 102 adopts sheet metal structure with adjustable shape; wherein, the plastic part 103 includes four clip structures 105 to fix other auxiliary structures on the dipole.

According to the dipole in this embodiment, the cost is reduced by about 40% compared with the prior art, and then the antenna cost is reduced by about 15%; Since the feeding line is connected with the dipole body in a capacity coupled manner, soldering joints can be removed, which can reduce the quality risk caused by poor soldering and avoid PIM problems caused by insufficient soldering quality. The weight of the dipole in this embodiment is about 30 g, which reduces about 33% compared with the 45 g dipole in the prior art, thus reducing the total weight of the antenna. In addition, the shape and connection interface of the dipole are similar to the existing dipole, so it is easy to replace in the existing antenna. Moreover, according to the dipole in this embodiment, the antenna quality and the First Pass Yield (FPY) can be significantly improved.

To those skilled in the art, it is apparent that the present disclosure is not limited to the details of the above exemplary embodiments, and the present disclosure may be implemented with other forms without departing from the spirit or basic features of the present disclosure. Thus, in any way, the embodiments should be regarded as exemplary, not limitative; the scope of the present disclosure is limited by the appended claims, instead of the above depiction. Thus, all variations intended to fall into the meaning and scope of equivalent elements of the claims should be covered within the present disclosure. No reference signs in the claims should be regarded as limiting the involved claims Besides, it is apparent that the term "comprise/comprising/include/including" does not exclude other units or steps, and singularity does not exclude plurality. A plurality of units or means stated in the apparatus claims may also be implemented by a single unit or means through software or hardware. Terms such as the first and the second are used to indicate names, but do not indicate any particular sequence.

What is claimed is:

1. A dipole, wherein the dipole comprises a dipole body and a feeding line used for connecting to the dipole body, wherein the dipole body comprises an asymmetric wing feature structure, wherein the dipole also comprises at least one plastic part, and the feeding line is connected with the dipole body in a capacity coupled manner through the at least one plastic part.

2. The dipole according to claim 1, wherein the asymmetric wing feature structure is of slim shape.

3. The dipole according to claim 1, wherein the shape of the feeding line can be adjusted.

4. The dipole according to claim 1, wherein the feeding line adopts sheet metal structure or die casting structure.

5. The dipole according to claim 1, wherein the dipole comprises only one plastic part.

6. The dipole according to claim 1, wherein the at least one plastic part comprises a clip structure configured to fix other structures on the dipole.

7. The dipole according to claim 1, wherein the dipole is connected to the reflector plate in a screw connection manner.

* * * * *